United States Patent [19]

Braun et al.

[11] 4,225,255

[45] Sep. 30, 1980

[54] LIQUID FLOW CONTROLLING DISPENSING PLUG FOR WIPE-ON APPLICATOR

[75] Inventors: Morris Braun, Chicago, Ill.; George B. Spransy, Oconomowoc, Wis.

[73] Assignee: W. Braun Co., Chicago, Ill.

[21] Appl. No.: 7,494

[22] Filed: Feb. 23, 1979

[51] Int. Cl.[3] ..... A47L 1/08

[52] U.S. Cl. ..... 401/137; 401/265

[58] Field of Search ..... 401/137, 202, 265, 266, 401/264, 292, 260, 206

[56] References Cited

U.S. PATENT DOCUMENTS

| | | | |
|---|---|---|---|
| 1,826,587 | 10/1931 | Wright | 401/265 X |
| 2,853,727 | 9/1958 | Nadai | 401/202 |
| 2,921,324 | 1/1960 | Gibbons | 401/266 X |
| 3,179,972 | 4/1965 | Fillmore | 401/202 |
| 3,192,923 | 7/1965 | Ackerman | 401/266 X |
| 3,365,745 | 1/1968 | Conte | 401/266 |
| 3,467,478 | 9/1969 | Webber | 401/265 X |
| 3,610,766 | 10/1971 | Herrnring | 401/265 |
| 3,680,968 | 8/1972 | Schwartzman et al. | 401/260 X |

*Primary Examiner*—John D. Yasko

*Attorney, Agent, or Firm*—Kegan, Kegan & Berkman

[57] ABSTRACT

A fluid-flow-regulating contact applicator consisting of a plug or sleeve secured as a closure for a liquid dispensing bottle or similar container. The applicator is formed with a plurality of liquid-permeable ducts extending through a top wall thereof to provide fluid flow communication between the interior of the container and the ambient system. The ducts are physically dimensioned so as effectively to invoke surface tension molecular forces including capillary forces to preclude free flow of liquid through the ducts in response to gravitation alone, but to allow through flow of liquid when an outer face of the applicator is presented to and establishes contact between liquid contained in the duct and a surface to which the liquid is to be applied, thereby overcoming flow-inhibiting surface tension forces.

6 Claims, 7 Drawing Figures

LIQUID FLOW CONTROLLING DISPENSING PLUG FOR WIPE-ON APPLICATOR

BACKGROUND OF THE INVENTION

The present invention relates to a fluid applicator of the contact or "wipe-on" type. More particularly, the invention is directed to an applicator for the controlled passage and release of a fluid from a storage container or bottle to a surface to which the fluid is to be applied.

The prior art is replete with fluid applicators of many types including applicators designed specifically for coating a body surface with a fluid film. In one type of "applicator" the transfer of the fluid from the container to the body surface is effected without direct contact between the container of dispenser and the area to be treated. That is, the fluid is applied by spraying utilizing either an aerosol propellant or a pumping mechanism.

In a second general type of apparatus a roll-on ball is used to transfer liquid from the reservoir in a container to the body surface.

While each of the above types of devices may serve a useful role under appropriate circumstances, the mechanism of each is relatively complex and costly. Aerosol valve mechanisms must be manufactured to exacting standards as must pumping apparatus of the type capable of producing a directed, uniform atomized spray. Roll-on ball applicators must be carefully dimensioned in appropriately designed and structured fitments so that both spillage from the dispenser and clogging of the fluid flow paths will be obviated. In spite of the long-time interest in fluid applicators, and notwithstanding the extensive research and developmental work which has been carried out, none of the prior art mechanisms is totally free of shortcomings and objectionable features.

It is, therefore, a principal aim of the present invention to provide a simple yet highly effective mechanical applicator which may be readily and reliably used to apply a liquid in the form of a film from a storage container to a selected surface. It is a related object of the invention to provide a fluid applicator which is totally devoid of "moving" parts.

SUMMARY OF THE INVENTION

The present invention comprises a fluid-flow-regulating surface-contacting applicator consisting of a dispensing plug which is conveniently secured as a closure for a bottle or similar container. The applicator is formed with a plurality of liquid-permeable ducts which extend transversely through a top wall of the applicator to provide fluid flow communication between the interior of the container and the ambient system. The ducts are of such physical dimensions as effectively to invoke surface tension molecular forces including capillary forces as a means to prevent free or unrestricted flow of liquid through the ducts in response to gravitational forces alone, but which allow through flow of the liquid when an outer face of the applicator is presented to establish contact between the liquid contained in the duct and a surface to which the liquid is to be applied, thereby overcoming flow-inhibiting surface tension forces.

In preferred embodiments of the invention, the liquids to be dispensed may be lotions, colognes, cosmetic specialty items, medicinals or any other fluid preparations. It is contemplated that the invention will have special utility in the application of such fluids to selected body surfaces.

It is an important object of the invention that the applicator plug may be readily attached to be made part of bottles or containers which may be fabricated either of glass or plastic compositions. In a preferred embodiment, the plug itself is plastic.

A related feature of the invention is that the applicator plug may be used in conjunction with presently available bottles of various types, without any significant modification of the bottle structure.

It is a feature of the plug of the invention that it may, with little and very simple structural variation be made adaptable for use either as an internal plug frictionally secured in the open neck of the bottle, or as an oversleeve, if preferred.

A related object of the invention is that it may conveniently be fabricated of a semi-hard plastic of the type which is readily frictionally securable to a cooperating member without the use of the glues or adhesives.

An important functional feature of the applicator of the invention is that it effectively prevents the discharge of liquid from the container even when the assembly is inverted, but permits the delivery of fluid to a contacted surface when the outer face of the applicator is presented to that surface.

A related feature of the invention is that the applicator plug allows controlled and continuous feeding of fluid through the plug and onto the surface to be coated as the face of the plug is wiped over that surface.

It is a physical characteristic and property of the applicator plug of the invention that the fluid passages through the delivery wall of the plug are so dimensioned that the surface tension molecular forces and the capillary forces involved preclude free flow of liquid through the ducts in response to gravitation alone. The ducts do, however, permit free passage of fluid therethrough when the outer face of the applicator is presented to and establishes contact between the surface to which the fluid is to be applied and the fluid contained in the duct.

It will be appreciated that such physical parameters as the viscosity and the surface tension of the liquid to be dispensed will affect the selection of appropriate duct dimensions and the configurations, to achieve the desired fluid flow characteristics—all within the teachings of the present invention.

Other and further objects, features, and advantages of the invention will be evident from the following description considered in conjunction with the drawings.

DESCRIPTION OF PREFERRED EMBODIMENTS

Figure 1:
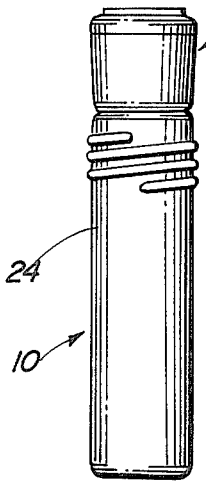
FIG. 1 is a front elevational view of a bottle or container of the type in which the applicator plug of the invention finds utility.
Figure 4:
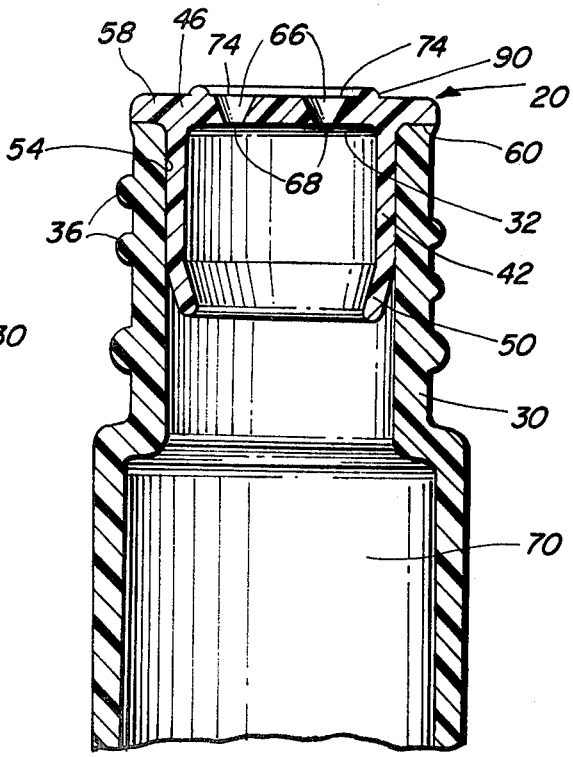
FIG. 4 is an enlarged fragmentary view of the upper portion of a bottle in which the embodiment of the applicator constitutes an internal plug secured within the throat or neck of the bottle.
Figure 5:
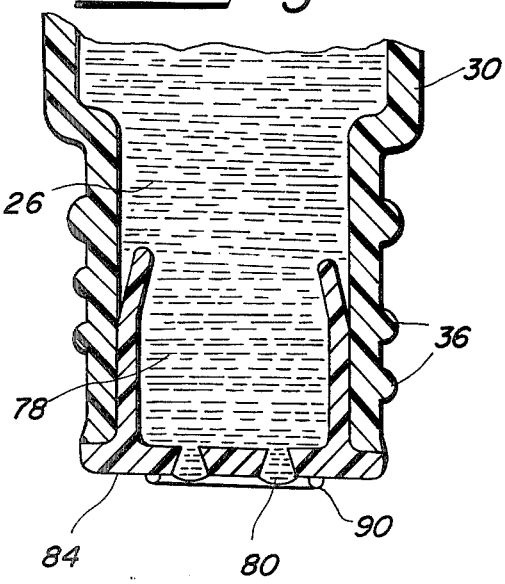
FIG. 5 is an enlarged fragmentary view of the embodiment of the invention shown in FIG. 4, with the container inverted to show, schematically, the manner in which the fluid contents are retained, even against gravitational forces.

The aims and objects of the invention are achieved, in a preferred embodiment of the invention, by providing a plug or applicator which is readily securable, frictionally, to constitute a fluid-flow regulating mechanism bridging the open mouth of the bottle or other container which serves as the reservoir for a liquid which is to be applied to a body surface. The plug is formed with through pores or ducts the physical dimensions of which are such that surface tension and capillary forces present are effective to overcome the gravitational force acting upon the contained liquid when the applicator assembly is inverted. It is an important feature of the invention that, as a result of the specific mechanical structure, the flow of fluid from the reservoir, through the applicator pores, occurs only when the applicator face is brought proximate the surface to which the fluid is to be applied, so that actual contact occurs between that surface and the fluid restrained by the applicator plug. Referring now to the drawings, and particularly to FIGS. 1, 4 and 5, there is shown, for illustrative purposes, a container 10 with one embodiment of the applicator 20 of the invention secured thereto. In the particular example illustrated, the fluid container 10 constitutes an elongated generally cylindrical vial 24 which serves as the reservoir for the liquid 26 to be dispnsed. The vial 24 is integrally formed at its upper end with a neck 30 having an open mouth 32. The neck is formed with encircling outer threads 36 for mating threaded engagement with internal threads, (not shown) of a closure or cap 40.

In the embodiment of the invention depicted in FIGS. 4 and 5, the applicator 20 constitutes a generally cylindrical or tubular body wall 42 surmounted by an integrally formed, generally planer, horizontally extending top wall 46. In the specific form of the applicator shown, the lower, depending end portion of the cylindrical wall 42 is angled or tapered inwardly to define a skirt 50 having a somewhat reduced overall diameter to facilitate the forced insertion of the cylindrical wall into the neck 30 of the container 10 to establish fluid-tight contiguous contact with the internal, annularly coextensive wall face 54 thereof, as shown in FIG. 4. A radially outwardly extending circumferential flange projects, as a continuation of the top wall 46 of the applicator and serves as a cap for the end face 60 of the bottle neck 30 so that the composite assembly presents a pleasing and aesthetic overall appearance.

There is formed in the top wall 46 of the applicator plug 20 a plurality of liquid-permeable ducts 66, each duct 66 communicating through a fluid inlet port 68 to the interior 70 of the fluid reservoir or container 10. At their opposite ends, the ducts 66 communicate with the ambient atmosphere at fluid discharge ports 74.

The ducts 66 are characterized in that they function so as to prevent through fluid flow under one set of conditions while permitting fluid passage under a second set of conditions. Specifically, the physical dimensions of the ducts 66 are such as effectively to establish surface tension molecular forces including capillary forces which act on liquid contained on the ducts 66 and at the discharge ports 74 thereof to oppose and to overcome gravitational forces acting on the liquid 26 contained in the duct 66 (FIG. 5) when the container 10 is an inverted disposition, to prevent unrestricted, free flow of liquid through the duct 66 and from the discharge port 74.

As indicated schematically in FIG. 5, with the container in an inverted position and the liquid 26 of the container filling the neck portion 78 of the container 10, the resultant of capillary forces, surface tension forces, and gravitational forces, is to produce a quasi-stable meniscus 80 depending from the exit port 74 and beyond the outer, limiting planar surface 84 of the top wall 46 of the plug 20. In the absence of actual contact between the hanging surface of the meniscus 80 and a mechanical object (e.g., a surface to be coated), the system remains in equilibrium and static. No fluid flow occurs. However, when a surface, such as a body surface (not shown) to which the fluid is to be applied is brought into contact with the meniscus 80, the equilibrium is upset and flow of fluid through the ducts 66 is initiated and continues as the applicator plug 20 is wiped across the surface to be wetted.

In order more effectively to control the rate of release of fluid through the ducts 66 and to control the degree of contact between the surface to be wetted and the depending meniscus 80, in the particular preferred embodiment of the invention illustrated, the container-spanning or bridging wall 46 of the applicator 20 is formed on its outer planar face with an upstanding, annular ring 90 which serves as spacer means establishing a fixed spatial relationship between the contacting surface and the proximate, depending meniscus 80. It will be appreciated that upon contacting the ring 80 against a body surface, the application of even the slightest pressure will cause a projection or invasion of the mobile skin interiorly of the ring 90 and into contact with the meniscus 80 of the fluid 26, upsetting the existing equilibrium and causing the fluid to flow through the feed ducts 66, consistent with established principles of fluid flow dynamics and physics. Upon physical displacement of the ring 90 from the body surface, the flow through the duct 66 will immediately terminate.

In the light of the present disclosure, it will be appreciated that there is a critical relationship between the fluid flow properties through the ducts 66 and the physical dimensions of the ducts, as well as their configurations. It will also be appreciated that the specific dimensions will depend in part upon the nature of the fluid being dispensed including the surface tension and viscosity of that fluid. In the case of a cologne, it has been found, that a satisfactory duct dimension is one in which the through thickness of the duct 66 is about 0.4 inch and in which the duct defines in cross section a passage which tapers outwardly from the inner surface to the outer surface of the outer wall 46 from an inlet port 68 having a transverse dimension of about 0.02 inch diameter to an outlet port 74 having a transverse diametric dimensions of about 0.06 inch. The ducts 66 taper or flare outwardly toward the discharge ports 74, the duct walls defining, in vertical cross section, an angle of about 60°. This angle may be varied in the range from about 45° to about 120°. Based upon the information provided herein, those skilled in the art will have little difficulty in arriving at suitable dimensions for other liquid compositions, all without exercise of the inventive faculty.

Figure 2:
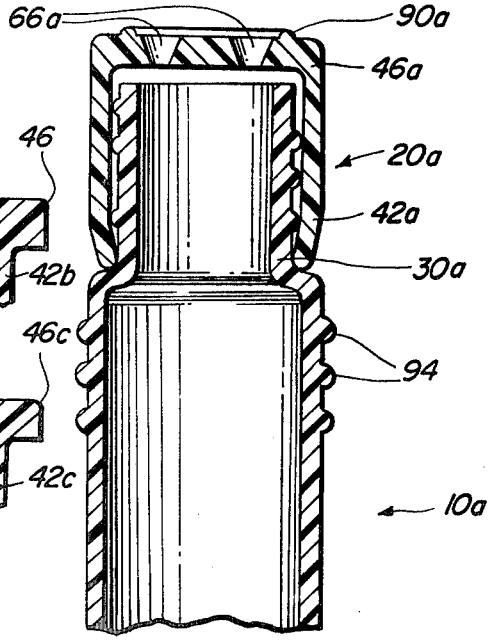
FIG. 2 is an enlarged, fragmentary view of the upper portion of a bottle with one embodiment of the applicator plug secured as an oversleeve.
Figure 3:
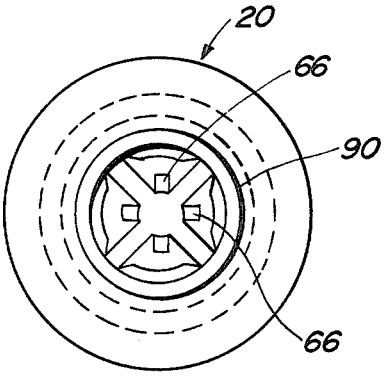
FIG. 3 is a top plan view of the applicator plug of FIG. 4.

In the embodiment of the invention illustrated in FIG. 2, a somewhat modified form of applicator 20*a* is shown. The principal difference in this structure is that it attaches as an oversleeve, being formed with an integral generally cylindrical wall 42*a* which slidably and frictionally overrides the neck 30*a* of the bottle or container 10*a*. In this particular embodiment of the assembly, the container 10*a* is conveniently formed with encircling external threads 94 adapted to mate with and interengage cooperating internal threads formed on a cap or cover (not shown) serving as a closure for the assembly. From a functional standpoint, the applicator 20*a* of FIG. 2 operates essentially in the same manner as described with reference to the embodiment of FIGS. 4 and 5. In the applicator plug structures shown in the fragmentary views, FIGS. 6 and 7, parts corresponding to those depicted in FIGS. 4 and 5 carry the suffices "b" and "c".

Figure 6:
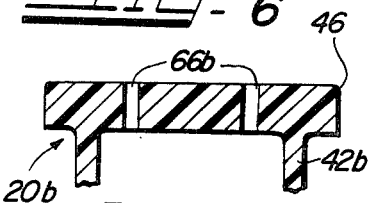
FIGS. 6 and 7 are fragmentary cross sectional views showing other possible configurations of the fluid passages in the applicator plug of the invention.
Figure 7:
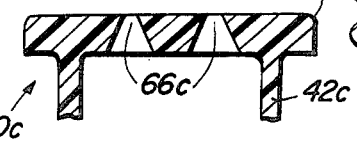

In the embodiment of the applicator shown in FIG. 6 the ducts 66*b* are essentially of constant cross sectional area. In FIG. 7, the ducts 66*c* taper inwardly from the interior to the exterior surface of the outer wall 46*c* of the applicator plug 20*c*.

The foregoing invention has been described with reference to a preferred embodiment, and numerous equivalents thereof can be made without departing from the spirit and scope of the invention as defined in the following claims.

What is claimed is:

1. In an assembly for the controlled dispensing of a liquid, including a container for a liquid to be dispensed, said container having an outlet end, a fluid-flow-control applicator, attachment means for securing said applicator to said container at said outlet end thereof, said applicator including a top wall spanning said outlet end of said container, said top wall being formed with a plurality of openings extending transversely therethrough, said openings constituting liquid-permeable ducts each having a fluid inlet port in communication with the interior of said container and a fluid discharge port in communication with ambient atmosphere to establish fluid communication between the interior of said container and ambient atmosphere, said ducts having a transverse cross-sectional area which is inconstant along the fluid-flow length thereof, a cross-sectional area of each of said ducts at said ducts as determined at an axial position of each of said ducts which is intermediate the area of the opposed inlet and discharge ends thereof, each of said ducts having bounding slanted walls which define in vertical cross section an angle in the range of from about 45° to about 120°, said ducts in said applicator being characterized in that they inhibit significant flow of liquid from said container through said top wall of said applicator and control discharge of fluid from each said discharge port to prevent flow from said container under gravitational forces alone, and in that they allow flow of liquid from said container through said top wall of said applicator and discharge of liquid from each said discharge port only upon inversion of said container and presentation of said applicator to a surface to which the liquid is to be applied, spacer means carried by said top wall of said applicator, said spacer means comprising a collar surmounting and circumscribing a liquid-dispensing end of said ducts and extending in a plane generally normal to a through passage of said ducts to establish a finite controlled spacing between discharge ports of said ducts and a plane of an upper edge of said collar defining a contact ring thereof, each said discharge port being recessed with respect to a liquid-application surface to which said ring of said applicator is contacted during functional dispensing of liquid from said container, physical dimensions of each of said ducts, each said inlet port, and each said discharge port being effective to establish surface tension molecular forces including capillary forces which act on a liquid contained in said ducts and at each said discharge port thereof to oppose and to overcome gravitational forces acting on the liquid contained in said ducts when said container is in an inverted disposition, thereby to establish a meniscus of the liquid at said discharge port and to prevent unrestricted free flow of liquid through said ducts and from each said discharge port;

whereby presentation of said applicator to a surface to be wetted serves to bridge said spacer means and to establish contact between said surface and the meniscus of the liquid at each said discharge port of said ducts, thereby to overcome said surface tension molecular forces including said capillary forces, to allow flow of liquid through each said discharge port to wet said surface.

2. The structure as set forth in claim 1 wherein said duct has a transverse cross sectional area which is inconstant along the fluid-flow length thereof and wherein a cross-sectional area of said duct at said fluid discharge port exceeds a cross-sectional area of said duct as determined at an axial position of said duct which is intermediate the area of the opposed inlet and discharge ends thereof.

3. The structure as set forth in claim 2 wherein said duct has bounding slanted walls which define in vertical cross section an angle in the range of from about 45° to about 120°.

4. The structure as set forth in claim 1 wherein said top wall has a through thickness of about 0.04 inch, and wherein said ducts extending through said top wall of said applicator define in cross section passages which taper outwardly from the inner to the outer surface of said outer wall from an inlet port having a transverse dimension of about 0.02 inch to an outlet port having a transverse dimension of about 0.06 inch.

5. The structure as set forth in claim 1 wherein said applicator includes an integrally-formed, generally-cylindrical skirt depending from said top wall of said applicator, said skirt being adapted firmly to engage an upper neck zone of said container to establish a fluid-tight seal between said container and said applicator, said skirt being slidably received within said container, and wherein outer portions of said skirt contact contiguously and stressingly engage said container in liquid-sealing abutment therewith.

6. The structure as set forth in claim 1 and further comprising a skirt slidably received over, securely to embrace an upper portion of said container in liquid-sealing engagement therewith.

* * * * *